US005712557A

United States Patent [19]

Gehrt et al.

[11] Patent Number: 5,712,557

[45] Date of Patent: Jan. 27, 1998

[54] CONSTANT CURRENT SUPPLY CIRCUIT WITH STABILIZATION BASED ON VOLTAGE AND CURRENT RATIOS RELATIVE TO A REFERENCE VOLTAGE AND A RELATED CONTROL CURRENT

[75] Inventors: Holger Gehrt, Rosengarten; Wolfgang Schnitt, Norderstedt; Joachim Utzig, Buxtehude; Gert Bierkarre, Escheburg, all of Germany

[73] Assignee: U.S. Philips Corporation, New York, N.Y.

[21] Appl. No.: 701,283

[22] Filed: Aug. 22, 1996

[30] Foreign Application Priority Data

Aug. 22, 1995 [DE] Germany ..... 195 30 737.2

[51] Int. Cl.[6] ..... G05F 3/16

[52] U.S. Cl. ..... 323/316

[58] Field of Search ..... 323/316–321, 323/20–21; 363/59–61

[56] References Cited

U.S. PATENT DOCUMENTS 4,210,996 7/1980 Amemiya et al. ..... 29/610
5,576,616 11/1996 Rodgers ..... 323/314

FOREIGN PATENT DOCUMENTS

0490016A1 6/1992 European Pat. Off. .
0543056A1 5/1993 European Pat. Off. .
3610158C2 10/1987 Germany .

OTHER PUBLICATIONS

"A Physical Mechanism of Current–Induced Resistance Decrease in Heavily Doped Polysilicon Resistors", by Kato et al, IEEE Transactions on Electron Devices, vol. Ed. 29, No. 8, Aug. 1982, pp. 1156–1161.

"Stromstabilisierung in Bipolar Integrierten Schaltungen", by Dr. Rolf Bohme, Elektronik, vol. 5, 4.3, 1988, pp. 129–133.

*Primary Examiner*—Aditya Krishnan
*Attorney, Agent, or Firm*—Leroy Eason

[57] ABSTRACT

A circuit arrangement for supplying a constant current which is stabilized against temperature variations. The constant current is produced by a current source which is controlled by a control stage in which a first control current is supplied to each of a first and a second resistor, at least one of which is trimmable. The first control current is controlled so that the difference between the voltages produced thereby across the first and second resistors is in a first predetermined ratio to the constant voltage produced by a reference voltage source. The current source is controlled by the control stage so that the constant current produced thereby is in a second predetermined ratio to the first control currents.

8 Claims, 2 Drawing Sheets

CONSTANT CURRENT SUPPLY CIRCUIT WITH STABILIZATION BASED ON VOLTAGE AND CURRENT RATIOS RELATIVE TO A REFERENCE VOLTAGE AND A RELATED CONTROL CURRENT

BACKGROUND OF THE INVENTION

1. Field of the Invention

The invention relates to a circuit arrangement for supplying a constant current, comprising a reference voltage source for supplying a constant voltage, and a current source controlled by the reference voltage source via an amplifier circuit and capable of supplying the constant current.

2. Description of the Related Art

The paper "Stromstabilisierung in bipolar integrierten Schaltungen" by Dr. Rolf Boehme, published in "Elektronik", Volume 5, 4.3.1988, pp. 129 to 133, discloses current stabilizing circuits in which stable currents are derived from a reference voltage source. As the reference voltage source a band-gap stabilizer is used to which a high-precision resistor is connected, preferably via an operational amplifier. This results in a stabilized current through this resistor. However, said paper states that the resistors should be very precise in order to obtain small current stabilization errors. It has been found that even small resistance variations, for example as a result of temperature variations, give rise to comparatively large variations of the temperature characteristic of the stabilized currents. Therefore, the desired stabilities cannot be achieved with simple bipolar integration without trimming. A second undesirable aspect of bipolar integration is the large spread of the resistance values, from 10 to 20%, as occurs in the diffusion or implantation of integrated resistors. This means that the generated stabilized currents have a corresponding spread. An optimum accuracy therefore requires the use of a hybrid technique, in which an integrated transistor circuit is to be provided with one or more external resistors. The fabrication and adjustment of such devices is therefore too expensive for many fields of use.

DE-PS 36 10 158 discloses a reference current source based on the principle of band-gap stabilization. It utilizes temperature-dependent currents in the two band-gap stabilization transistors, which are connected in parallel with resistors having inverse temperature characteristics. The temperature variation of the currents through the band-gap stabilization transistors are then compensated by a precise dimensioning of these temperature characteristics. The currents in the resistors connected in parallel with the transistors should then increase as the temperature increases. However, when such a circuit arrangement is integrated on a semiconductor body the problem arises that the resistance values of resistors integrated in the semiconductor material increases at increasing temperature and so the currents through these resistors decrease.

SUMMARY OF THE INVENTION

It is an object of the invention to provide a circuit arrangement which supplies a constant temperature-stabilized current and which can be integrated wholly on a semiconductor body.

According to the invention this object is achieved in a circuit arrangement of the type defined in the opening paragraph which includes a control stage comprising a first and a second resistor, at least one of said resistors being trimmable, the control stage being capable of supplying to each of the first and the second resistor a first control current which is controllable so that the difference between the resulting voltages across the resistors is in a first predetermined ratio to the constant voltage of the reference voltage source, and the current source being coupled to the control stage and controlled thereby so that the constant current supplied by the current source is in a second predetermined ratio to the first control current.

In the circuit arrangement in accordance with the invention the constant current to be supplied is exclusively determined by predetermined current ratios or resistance ratios, which can be accomplished very simply and accurately by means of conventional semiconductor integration techniques, the absolute values of the currents or resistances defining said ratios being non-critical at least within wide margins which are easy to maintain from the fabrication technology viewpoint. Thus, the circuit arrangement in accordance with the invention can meet strict requirements as regards the accuracy of the constant current to be supplied, while the requirements imposed on the fabrication accuracy can be less exacting. The arrangement is based on a reference voltage source as also used in the prior art (band gap). An accurately reproducible portion of the constant voltage supplied by the reference voltage source is taken as a measure for adjusting the difference between the voltages appearing across the two resistors. For this purpose the first control current which flows through both resistors is controlled. This first control current, in its turn, bears a fixed predetermined ratio to the constant current to be supplied. An additional adjustment possibility is that at least one of said two resistors is trimmable.

Thus, the circuit arrangement in accordance with the invention enables a highly constant current to be obtained in a very simple manner, which current is stable without any special measures for adjustment or for compensation of oppositely oriented characteristics. Since the temperature dependence of the constant current to be supplied is only determined by the constant voltage of the reference voltage source, the difference between the voltages appearing across the first and the second resistor, and by a voltage ratio and a current ratio, and moreover since the constant voltage and said ratios are temperature independent, a temperature dependence can occur only as a result of said voltage difference. However, for a given first control current this voltage difference can be attributed to a difference between the resistance values, which can also be rendered independent of the temperature.

For this purpose, in a variant of the circuit arrangement in accordance with the invention, it is preferred that of the first and the second resistor at least the trimmable one is made of polycrystalline silicon (polysilicon resistor). Such resistors can be deposited very simply and cheaply as layers on semiconductor bodies with integrated circuits. As is disclosed in the paper by Kato et al: "A Physical Mechanism . . .", IEEE Transactions on Electron Devices, Band ED-29, Volume 8, August 1982, pages 1156 to 1161, such resistors can be trimmed to given resistance values by impressing given currents. However, this trimming only alters the resistance value at a given reference temperature but it does not affect the absolute change in the resistance value as a function of the temperature. In other words, the temperature coefficient of the trimmed polysilicon resistor changes in such a manner that a resistance difference between two such resistors having corresponding geometrical dimensions becomes temperature independent. If the circuit arrangement in accordance with the invention now uses such polysilicon resistors of identical dimensions as the first and the second resistor, it can be defined by a variable (trimmable) temperature-independent difference between two resistance values, as a result of which the constant current to be supplied becomes simply temperature independent.

In a preferred embodiment of the circuit arrangement in accordance with the invention the control stage further comprises:

- a third resistor, to which the constant voltage can be applied via the amplifier circuit and in which a second current can be generated by this constant voltage,
- a (first) current mirror circuit via which the second control current can be applied to a fourth resistor, and
- a comparator circuit arranged to compare the sum of the voltages across the fourth resistor and across the first resistor with the voltage across the second resistor and which controls the first control current in such a manner that said compared voltages correspond.

This construction of the control stage provides a preferred and simple possibility of maintaining the required high accuracy or constancy of the current to be supplied, with simple circuitry and comparatively moderate requirements on production tolerances. This is achieved in that, as already explained hereinbefore, current or resistance ratios are used for the generation of the control currants or voltages, which ratios do not or only to an insignificant extent depend on production spreads.

As a consequence, the circuit arrangement in accordance with the invention has the advantage that it can be integrated wholly on one semiconductor body, i.e. all the circuit elements of the circuit arrangement in accordance with the invention combined in one structure formed on this semiconductor body. As a result, the circuit arrangement in accordance with the invention becomes compact and cheap and can also be combined with further circuit arrangements not described herein, thus also enabling a higher degree of integration of these further circuit arrangements to be obtained.

BRIEF DESCRIPTION OF THE DRAWINGS

In the drawings, in which corresponding elements bear the same reference numerals.

DESCRIPTION OF THE PREFERRED EMBODIMENTS

Figure 1:
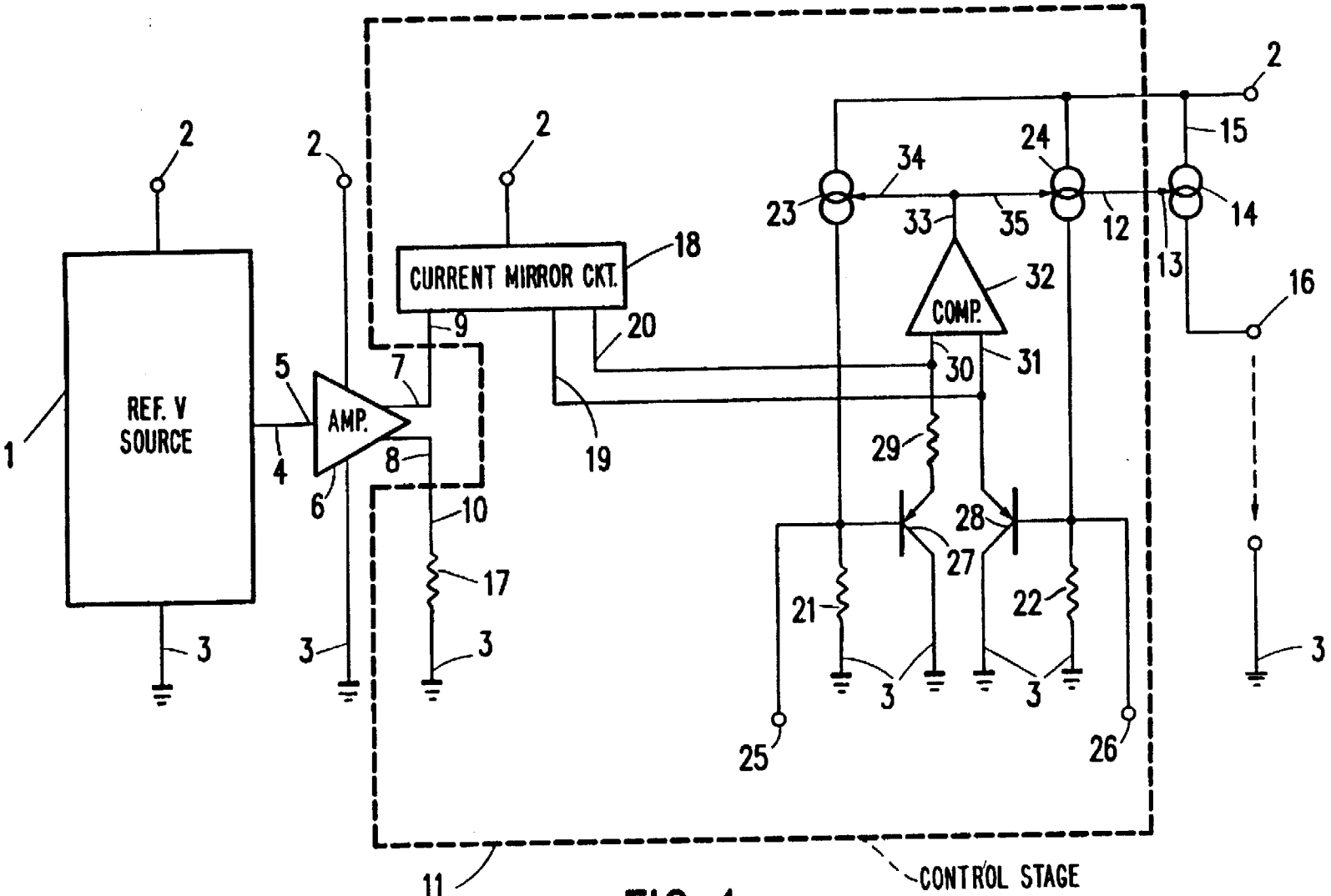
FIG. 1 shows a first embodiment of the circuit arrangement in accordance with the invention.

The circuit arrangement shown in FIG. 1 comprises a reference voltage source 1, which is constructed in known manner as a band-gap stabilizer and which is therefore not described in more detail. The reference voltage source is connected to a supply voltage terminal 2 for the application of a supply voltage and to ground 3 and it has a reference voltage terminal 4, at which it can produce a constant and temperature-stabilized voltage. The reference voltage terminal 4 is connected to an input 5 of an amplifier circuit 6, which is preferably an operational amplifier and is also connected to the supply voltage terminal 2 and to ground 3 for its power supply. The amplifier circuit 6 further has two outputs 7 and 8 and is preferably constructed in such a manner that it comprises a differential amplifier stage as input stage as well as an output transistor, the main current path of the output transistor being arranged between the outputs 7 and 8 of the amplifier circuit 6 and the input of the differential amplifier stage being formed by the input 5 of the amplifier circuit 6, the differential amplifier stage having a second input connected to the second output 8 of the amplifier circuit 6. As a result, the amplifier circuit 6 comprises an (internal) feedback path and preferably has a voltage gain of at least substantially unity between its input 5 and its second output 8. Moreover, the currents in the outputs 7 and 8 are at least substantially equal to one another.

The first and the second output 7 and 8 of the amplifier circuit 6 are connected, respectively, to inputs 9 and 10 of a control stage 11, which is further connected to the supply-voltage terminal 2 and to ground 3 and which is connected to a control input 13 of a controlled first source 14. The controlled current source 14 has a current terminal 15 connected to the supply-voltage terminal and a second current terminal 16 at which it is adapted to supply a constant temperature-stabilized current. This constant current is available at a point situated between the second current terminal 16 and ground 3 and indicated by the broken-line arrow.

The control stage 11 in the circuit arrangement in accordance with the invention serves to stabilize the constant current produced at the current terminal 16 of the controlled current source 14 with respect to the constant reference voltage produced at terminal 4 by The reference voltage source 1, the amplifier circuit 6 basically acts as an impedance matching stage on whose second output 8 said constant voltage is available with a low source impedance. For this purpose the control stage 11 comprises a third resistor 17 between its second input 10 and ground 3, through which third resistor a second control current flows which depends on the constant voltage and the resistance value of this third resistor. The temperature dependence of this second control current corresponds to that of the third resistor 17.

The first input 9 of the control stage 11 also forms an input of a first current mirror circuit 18 in the control stage 11. The first current mirror circuit 18 is further connected to the supply-voltage terminal 2 and has two outputs 19, 20 at which currents are available of the same magnitude as the current at the input 9. Since the last-mentioned current corresponds to the second control current in the third resistor 17 this second control current will also appear at each of the outputs 19, 20 of the first current mirror circuit 18.

The control stage 11 further comprises a first resistor 21 and a second resistor 22, which are each arranged in series with a controllable current source 23 and 24, respectively, between the supply-voltage terminal 2 and ground 3. A first tip 25 between the first resistor 21 and the first controllable current source 23 is connected to a control terminal (base) of a first transistor 27. A second tap between the second resistor 22 and the second controllable current source 24 is connected to a control terminal (base) of a second transistor 28. In the example shown in FIG. 1 these transistors 27, 28 are pnp transistors having their collector terminals connected to ground 3. The emitter terminal of the first transistor 27 is connected to the second output 20 of the first current mirror circuit 18 via a fourth resistor 29, while a direct connection has been provided between the emitter terminal of the second transistor 28 and the first output 19 of the first current mirror circuit 18. Moreover, the outputs 19 and 20 of the first current mirror circuit 18 are each connected to a respective input 30 or 31 of a comparator circuit 32, which preferably, in the same way as the amplifier stage 6, can be constructed as an operational amplifier whose input stage is a differential amplifier stage and whose an output stage is formed by an output transistor, but which preferably has no internal feedback in order to obtain a high gain. A control line leads from an output 33 of this comparator circuit 32 to control inputs 34 and 35 of the first and the second controllable current source 23 and 24, respectively, and to the control input 13 of the controlled current source 14, to which the first-mentioned control inputs are connected. The output 33 of the comparator circuit 32 thus forms the control output 12 of the control stage 11.

In operation of the circuit arrangement shown in FIG. 1 the first and the second controllable current source 23, 24 concurrently feed a first control current through the first and the second resistor 21 and 22. This first control current impressed concurrently on the resistors 21, 22 can be controlled by the comparator circuit 32. It produces voltages across the first and the second resistor 21 and 22. The voltage across the first resistor 21, added to the base-emitter voltage of the first transistor 27 and to the voltage produced across the fourth resistor 29 by the second control current, is applied to the first input 30 of the comparator circuit 32. The sum of the voltages the second resistor 22 and across the base-emitter junction of the second transistor 28 is applied to the second input 31 of the comparator circuit 32. The transistors 27, 28 are now driven by the voltages across resistors 21, 22 and by the second control current from the outputs 19, 20 of the first current mirror circuit 19 in such a manner that they operate in the forward region and their base-emitter voltages are at least substantially equal. The comparator circuit 32 thus compares the sum of the voltages the fourth resistor 29 and across the first resistor 21 with the voltage across the second resistor 22. The comparator circuit 32 controls the controllable current sources 23, 24 via its output 33 in the same sense in such a manner that the aforementioned voltages, i.e. the voltages at the inputs 30 and 31, correspond.

Moreover, the second control current is fed concurrently through the third resistor 17 and the fourth resistor 29. The voltages appearing across said resistors are consequently in the same ratio to another as their resistance values, the absolute magnitudes of these resistance values being of no significance. Here, only the resistance ratio is relevant, which ratio can be very stable even in the case of comparatively large spreads of the absolute values as a result of production tolerances. Thus, the voltage across the fourth resistor 29 is a very stable and accurate representation of the constant voltage supplied by the reference voltage source 1; these voltages are in a predetermined ratio to one another. The comparator circuit 32, on the other hand, controls the first control current in such a manner that the difference between the voltages across the first resistor 21 and across the second resistor 22 corresponds to the voltage across the fourth resistor 29, i.e. a given fraction of the constant voltage from the reference voltage source 1. However, the difference between the voltages across the first resistor 21 and across the second resistor 22 corresponds to the difference between the resistance values of the first and the second resistor 21 and 22, multiplied by the first control current through these resistors. Furthermore, the constant current (at the second current terminal 16) supplied by the controlled current source 14, which is controlled via the control output 12 of the control stage 11, is in a fixed (second) ratio to the first control current. Altogether, this means that the constant current to be obtained at the second current terminal 16 is a function of the current ratio between the first control current of the controllable current sources 23, 24 and the current of the controlled current source 14, the resistance ratio between the fourth resistor 29 and the third resistor 17, the constant voltage of the reference voltage source 1, and the difference between the resistance values of the first and the second resistor 21 and 22. If the difference between the resistance values of the first and the second resistors 21 and 22 is made temperature-independent, this ultimately results in a temperature-independent constant current, which is neither affected by fabrication tolerances.

In order to obtain a temperature-independent difference between two resistance values the invention utilizes the fact that the absolute resistance value of a resistor of polycrystalline silicon (polysilicon resistor) can be altered by means of a well-defined current impulse, starting from an initial value, in such a manner that a smaller absolute resistance is obtained but that the absolute resistance variation as a function of the temperature remains the same before and after the current impulse has been impressed on this resistor. In the case of temperature fluctuations the resistance value of such a polysilicon resistor before and after application of the current impulse, which is also referred to as "programming", changes by the same absolute resistance-value difference, i.e. independently of the absolute resistance value. The difference between the resistance values of two such resistors, and also the difference between the resistance values of a programmed and a non-programmed resistor, thus becomes temperature independent. If the first and the second resistor 21, 22 are constructed in this manner, this will yield the desired temperature independence of the constant current to be supplied.

Thus, in accordance with the invention at least the first or the second resistor 21 or 22, but preferably the first resistor 21, is trimmable, i.e. programmable. This trimming or programming advantageously makes it possible, starting from two resistors 21, 21 having the same resistance value and a similar temperature dependence, to reduce the absolute value of a resistor, preferably the first resistor 21, by a well-defined amount, without its temperature dependence, i.e. the absolute change in resistance value as a function of the temperature, being changed. For this purpose, at least the resistor to be trimmed (the first resistor 21) should be constructed as a trimmable, i.e. programmable, polysilicon resistor, but preferably the first and the second resistor 21 and 22 are of identical construction. In principle, the second resistor 22 can then also be trimmed, which provides an additional degree of freedom for the adjustment of the circuit arrangement in accordance with the invention.

Figure 2:
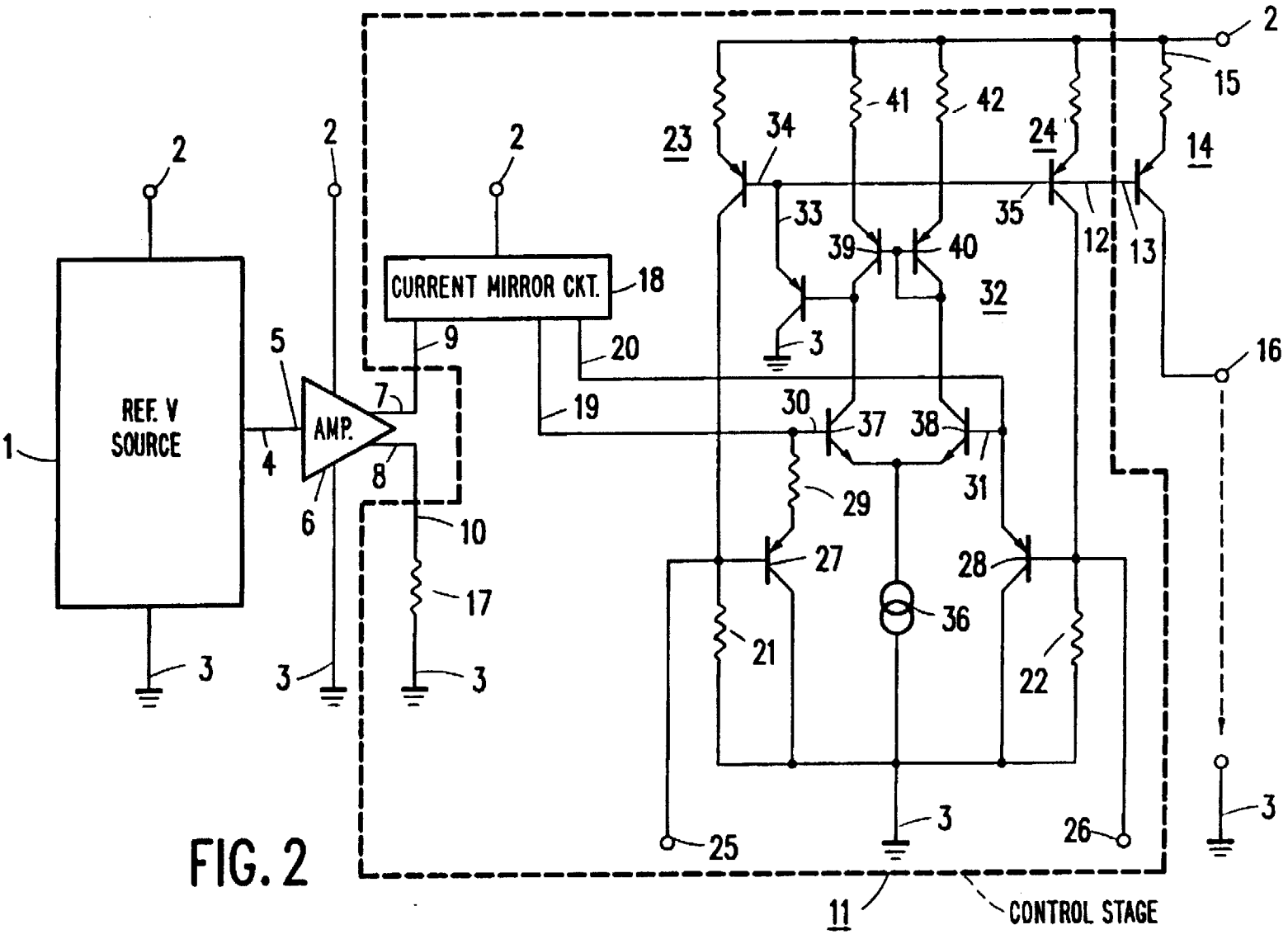
FIG. 2 shows the circuit arrangement of FIG. 1 partly in greater detail.

FIG. 2 shows the current sources 14, 23, 24 and the comparator circuit 32 in somewhat more detail than in FIG. 1. The current sources 23, 24 and 14 each comprise a pnp transistor each having their emitter terminals connected to the supply-voltage terminal 2 via an emitter resistor and having their base terminals, which form the corresponding control inputs 13, 34 and 35, connected jointly to the output 33 of the comparator circuit 32. The collector terminal of the transistor of the first controllable current source 23 is connected to the first tap 25, the collector terminal of the transistor of the second controllable current source 24 is connected to the second tap 26, and the collector terminal of the transistor of the controlled current source 14 forms the second current terminal 16. The circuit comprising the transistors of the current sources 14, 23, 24 together form a second current mirror circuit.

The comparator circuit 32 comprises an emitter-coupled differential amplifier stage powered by a current source 36 and comprising two transistors 37 and 38, the base terminal of the (third) transistor 37 forming the first input and the base terminal of the (fourth) transistor 38 forming the second input 31 of the comparator circuit 32. The collector terminals of the transistors 37, 38 are interconnected via a current mirror circuit comprising two pnp transistors 39, 40 and two emitter resistors 41, 42, which are connected to the supply-voltage terminal 2; the collector terminal of the (third) transistor 37 is connected not only to the corresponding terminal of the third current mirror circuit 39, 40, 41, 42 but also to the base terminal of pnp output transistor 43 whose collector side is connected to ground 3 and whose emitter terminal forms the output 33 of the comparator circuit 32.

The circuit arrangements shown in FIGS. 1 and 2 have separately led-out taps 25, 26 in common. The above-mentioned current impulses for trimming the first and the second resistor 21 and 22, respectively, can optionally be applied via these taps.

We claim:

1. A circuit arrangement for supplying a constant current which is stabilized against temperature variations, comprising:

a reference voltage source for supplying a constant voltage, a constant current source which is controlled by the reference voltage source via an amplifier circuit, a control stage comprising a first and a second resistor, at least one of said resistors being trimmable, the control stage being adapted to supply to each of the first and the second resistors a first control current which is controllable so that the difference between the voltages produced thereby across the first and second resistors will be in a first predetermined ratio to the constant voltage of the reference voltage source, and the current source being coupled to the control stage and controlled thereby so that the constant current supplied by the constant current source will be in a second predetermined ratio to said first control current.

2. A circuit arrangement as claimed in claim 1, wherein at least the trimmable one of said first and second resistors is made of polycrystalline silicon.

3. A circuit arrangement as claimed in claim 1, wherein the control stage further comprises:

a third resistor, to which the constant voltage can be applied via the amplifier circuit and in which a second control current is generated by said constant voltage, a current mirror circuit via which the second control current is applied to a fourth resistor, and a comparator circuit for comparing the sum of the voltages across the first and fourth resistors with the voltage across the second resistor, and adjusting the first control current so that said compared voltages correspond to each other.

4. A circuit arrangement as claimed in claim 1, have a structure which has been wholly integrated on one semiconductor body.

5. A circuit arrangement as claimed in claim 2, wherein the control stage further comprises:

a third resistor, to which the constant voltage can be applied via the amplifier circuit and in which a second control current is generated by said constant voltage, a current mirror circuit via which the second control current is applied to a fourth resistor, and a comparator circuit for comparing the sum of the voltages across the first and fourth resistors with the voltage across the second resistor, and adjusting the first control current so that said compared voltages correspond to each other.

6. A circuit arrangement as claimed in claim 2, having a structure which has been wholly integrated on one semiconductor body.

7. A circuit arrangement as claimed in claim 3, having a structure which has been wholly integrated on one semiconductor body.

8. A circuit arrangement as claimed in claim 5, having a structure which has been wholly integrated on one semiconductor body.

* * * * *